United States Patent [19]

Kuo

[11] Patent Number: 4,670,917

[45] Date of Patent: Jun. 9, 1987

[54] STERILIZER FOR TOILET SPRAY ATTACHMENT

[76] Inventor: Dai-Ming Kuo, P.O. Box 10160, Taipei, Taiwan

[21] Appl. No.: 865,298

[22] Filed: May 21, 1986

Related U.S. Application Data

[63] Continuation-in-part of Ser. No. 787,147, Oct. 15, 1985, abandoned.

[51] Int. Cl.[4] ..... A47K 3/22; A61H 35/00

[52] U.S. Cl. ..... 4/443; 4/444; 4/447; 4/448; 4/420.4

[58] Field of Search ..... 4/443, 448, 420.1, 420.2, 4/420.3, 420.4, 420.5, 447, 596, 597

[56] References Cited

U.S. PATENT DOCUMENTS

| | | | |
|---|---|---|---|
| 2,826,761 | 3/1958 | Lazarus | 4/448 X |
| 3,808,608 | 5/1974 | Caplan | 4/448 |
| 3,995,326 | 12/1976 | Umann | 4/420.1 |
| 4,000,742 | 1/1977 | DiGlacomo | 4/420.1 X |
| 4,087,868 | 5/1978 | Gentz | 4/448 X |
| 4,242,764 | 1/1981 | Fukuda | 4/448 X |
| 4,422,190 | 12/1983 | Huang | 4/443 X |
| 4,432,105 | 2/1984 | Pitroda | 4/597 |
| 4,451,942 | 6/1984 | Hirano et al. | 4/443 |

*Primary Examiner*—Henry K. Artis

[57] ABSTRACT

A sterilizer for toilet spray attachment includes a reservoir filled with sterilizing agent or cleaning chemical, a delivery tube connected with the reservoir, a mixing portion connected with the delivery tube and connected between a water conduit for supplying a pressurized water and a spray nozzle adapted for spraying user's anus or genitals, whereby upon the supply of pressurized water, the liquid in the reservoir will be automatically drained or sucked into the mixing portion for thorough mixing and for final spraying and cleansing purposes for the toilet users.

2 Claims, 3 Drawing Figures

STERILIZER FOR TOILET SPRAY ATTACHMENT

BACKGROUND OF THE INVENTION

This application is a continuation-in-part of original application of Ser. No. 787,147 filed on Oct. 5, 1985.

The original application disclosed a sterilizer filled with sterilizing agents or cleaning chemicals which is automatically directed into a spray nozzle adapted to spraying and cleansing the user's anus or genitals for hygienic purposes. However, the original application did not mention a pressurized water source to develop pressure sufficient pressure to open a sealer of a delivery tube communicated from a liquid reservoir filled with sterilizing agent or cleaning chemical or to establish a flow rate of water sufficient to create a negative pressure or suction in the throat area communicated with the delivery tube of the cleaning liquid. It is therefore doubtful that the water flow will automatically pull in the liquid from the liquid reservoir for hygienic use.

The present inventor has remedied this defect by providing pressurized water source of sufficient pressure to open the sealer on the delivery tube of the toilet spraying system.

SUMMARY OF THE INVENTION

The object of the present invention is to provide a sterilizer filled with sterilizing agents or cleaning chemicals which will be automatically directed into a spray nozzle adapted for spraying and hygienically cleansing a user's anus or genitals.

DETAILED DESCRIPTION

Figure 1:
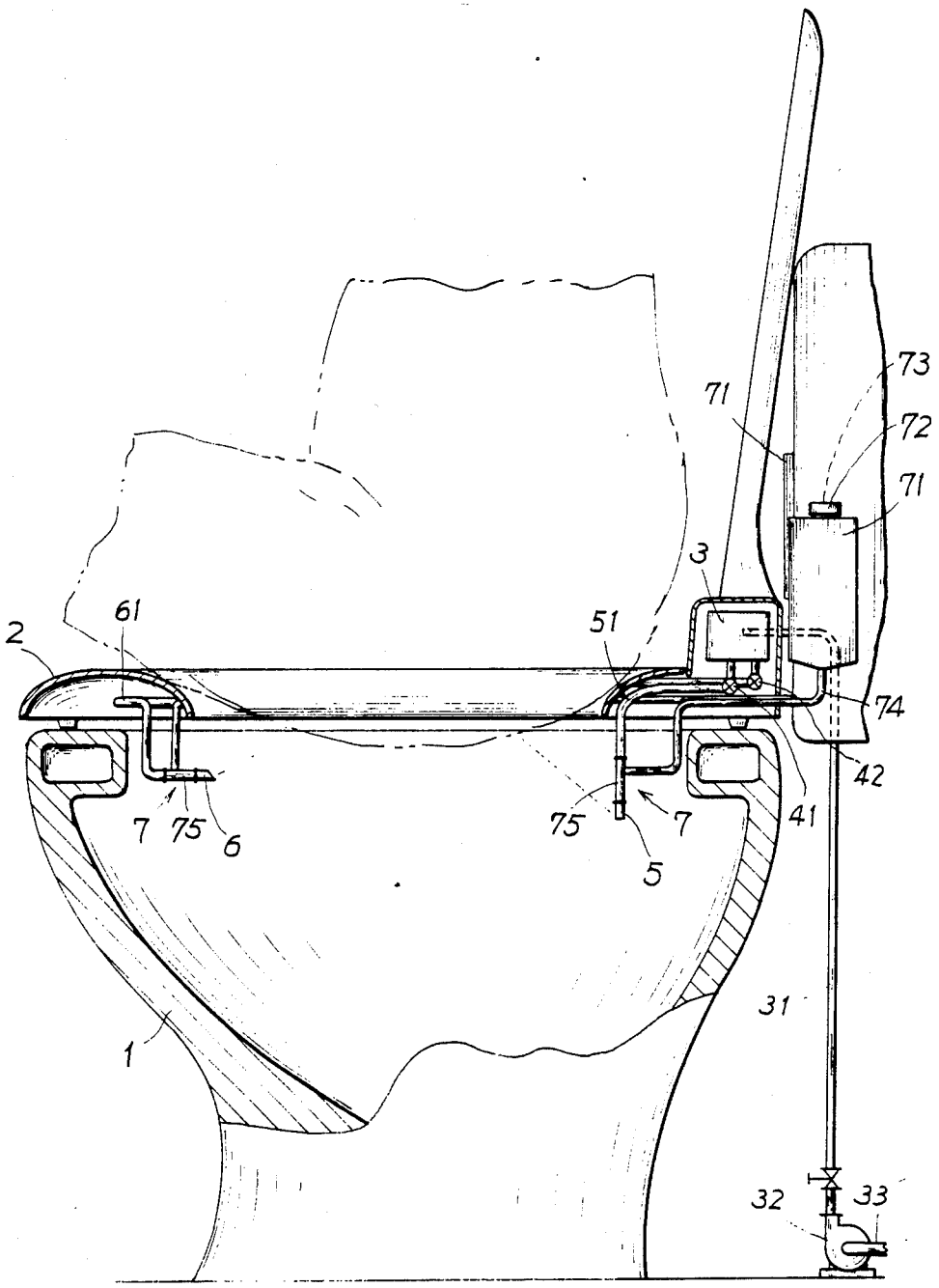
FIG. 1 is an illustration of the present invention.
Figure 2:
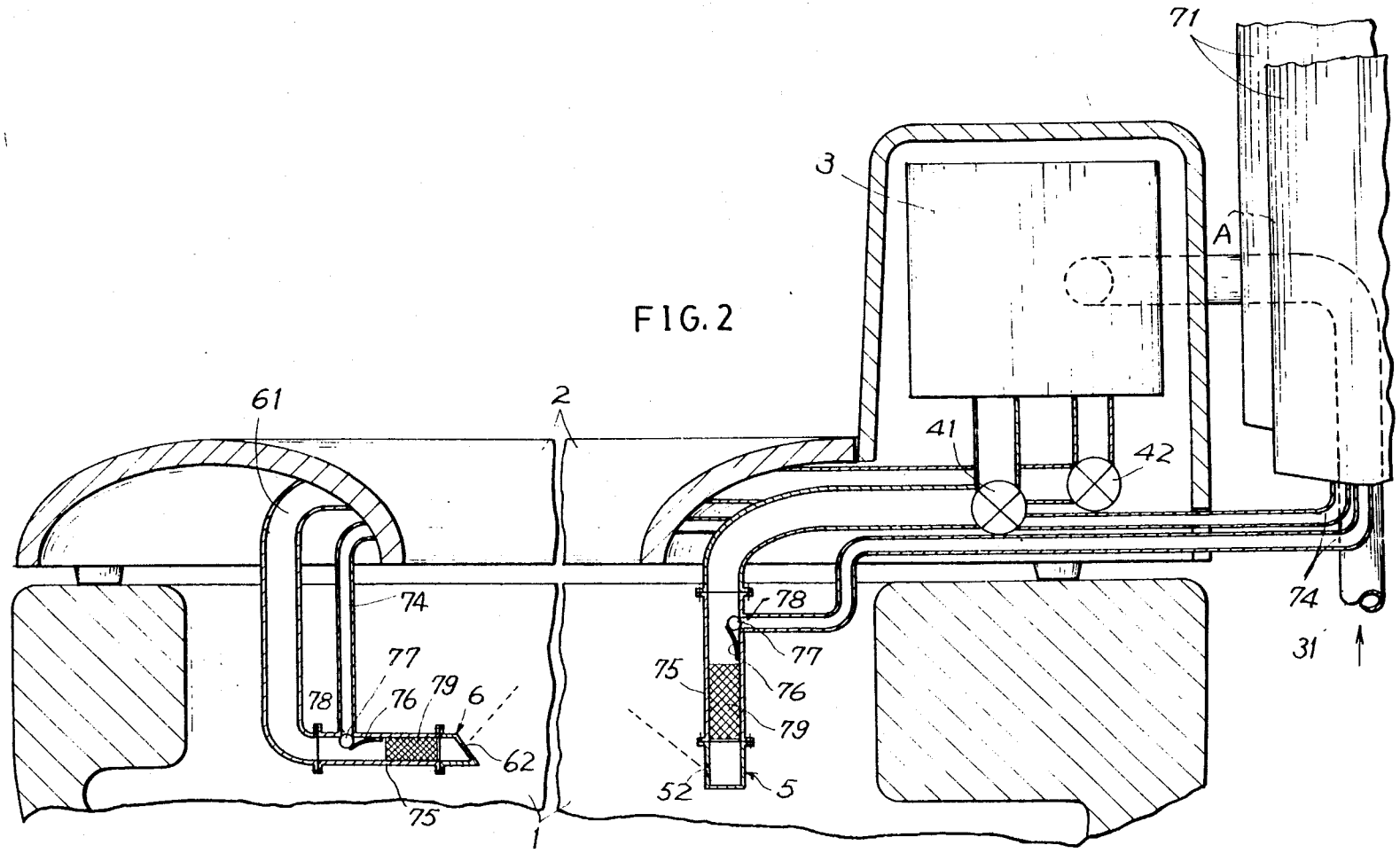
FIG. 2 is a sectional drawing of the present invention.

As shown in FIGS. 1 and 2, the present invention comprises a toilet bowl 1, a toilet seat 2, a warm water reservoir 3, a pair of water valves 41, 42 fixed on the two branch conduits 51, 61 communicated with the water reservoir 3, a rear spray nozzle 5, a front spray nozzle 6 and a pair of sterilizers 7.

Each sterilizer 7 includes a liquid reservoir 71 having a top cover 72 drilled with a venting hole 73 on the cover 72, a delivery tube 74 connected with the reservoir 71, a mixing portion 75 perpendicularly connected with the lower portion of the tube 74 as disposed within the toilet bowl 1 under toilet seat 2, a sealer 77 generally formed as a spherical shape and resiliently held by a spring link 76 which is secured towards the mixing portion 75 to normally seal a lower port 78 of delivery tube 74 and operatively opened by the downcoming water from a pressurized water source and a mixing mesh 79 inserted in mixing portion 75. The reservoir 71 may be filled with sterilizing agents or cleaning chemicals A for enhanced hygienic cleaning purposes for the toilet users.

The mixing portion 75 of the sterilizer 7 is vertically connected between the rear spray nozzle 5, including an injection port 52 and the water conduit 51, and positioned beyond the perpendicular connection of the lower portion of the delivery tube 74. Another mixing portion 75 of another sterilizer 7 is horizontally connected with the front spray nozzle 6 having an injection portion 62 and the water conduit 61, and positioned beyond the perpendicular connection of the lower portion of the other delivery tube 74. The installation position of the mixing portion 75 on the spray nozzle 5 or 6 is not limited and can be optionally chosen, such as in a horizontal, vertical or tilted position depending upon the applying situations. The warm water reservoir 3 is supplied with pressurized water through a pipe 31 by a boosting pump 32 which boosts the pressure of the incoming water from a water source (not shown) directed via inlet pipe 33.

When using the present invention, the water valves 41, 42 are opened to allow pressurized water flowing through the two branch conduits 51, 61 towards the downstream mixing portions 75 to open the sealers 77, whereby the liquid in tube 74 gravitationally flowing from each reservoirs 71 will drain into the mixing portion 75 and thoroughly mix with the downcoming water within the mixing mesh 79 and finally sprayed through nozles 5, 6 for cleaning the user's anus and genitals respectively.

Figure 3:
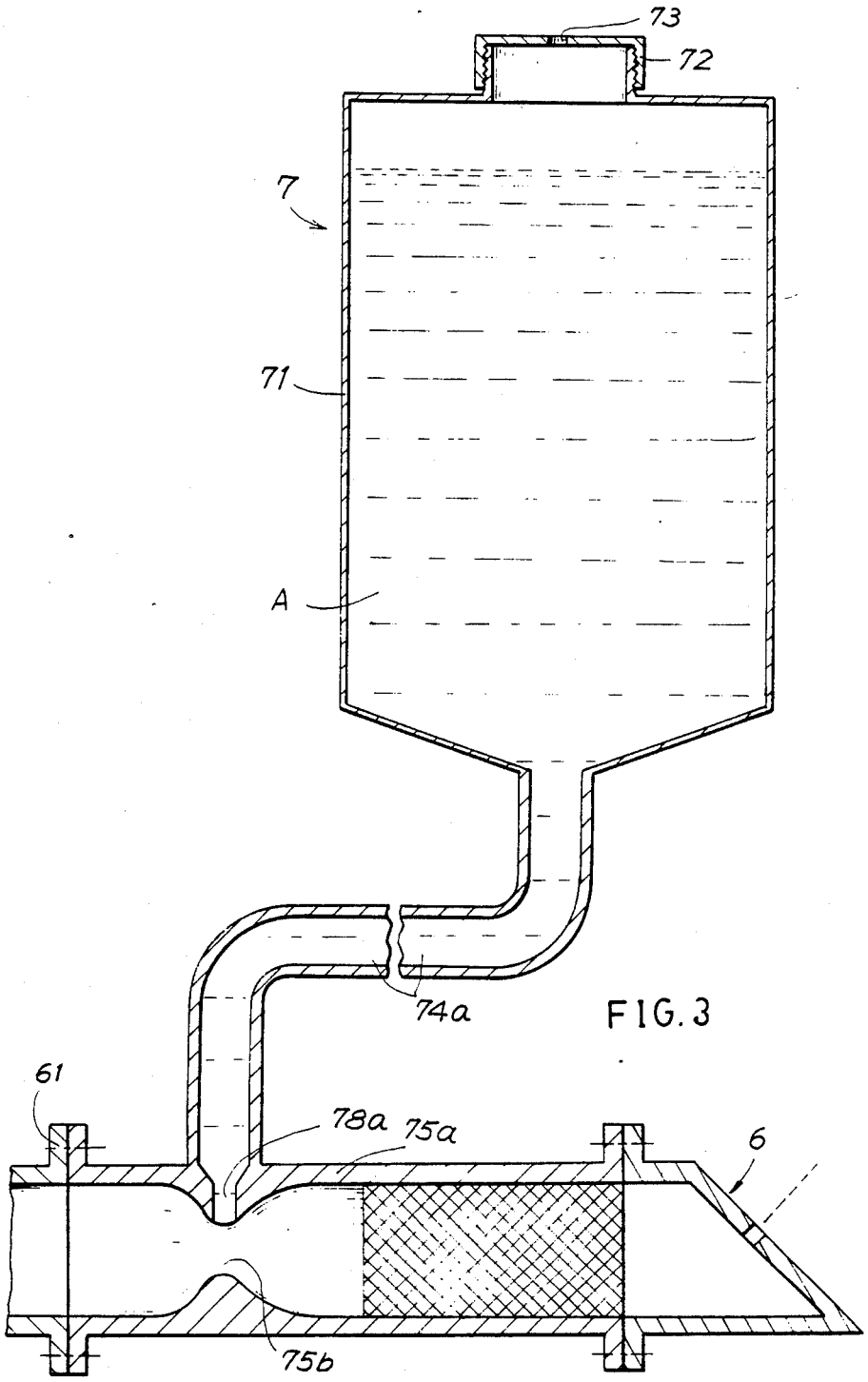
FIG. 3 shows another preferred embodiment of the present invention.

Another preferred embodiment of the present invention based on the toilet spraying system as aforementioned is shown in FIG. 3, which comprises a sterilizer 7 including a reservoir 71 having a top cover 72 drilled with a venting hole 73, a delivery tube **74*a* connected with the reservoir 71 and having a tapered small hole 78*a* on the discharge port of the tube 74*a* and a mixing portion 75*a* having a throat portion 75*b* communicated with tapered small hole 78*a* and a mesh 79 (not shown) inserted in the mixing portion 75*a*. The mixing portion 75*a* is connected with either spray nozzle 5 or 6, communicated with either water conduit 51 or 61 of water source 3 near the injection port 52 or 62** of either nozzle.

When using the sterilizer 7 of the present invention, either valve 41 or 42 is opened to lead pressurized water downwards to suck the liquid A from the reservoir 71 through the throat portion **75*b* and small hole 78*a*, whereby the liquid is thoroughly mixed with water in the mixing portion 75*a* for spraying and cleaning purposes for the users. When valve 41 or 42 is closed, the water is no longer drained and the liquid in tube 74*a*** will be normally held in situ as the cohesive force of the sterilizing agent or cleaning chemical acts upon the tube wall especially at the tapered small hole to cause no drainage loss of the liquid.

The boosting pump 32 of the present invention can be suitably chosen to develop a sufficient water pressure to open a sealer 77 of delivery tube 74 as shown in FIG. 2 for liquid drainage or to suck the liquid through the small hole **78*a* and throat portion 75*b* as shown in FIG. 3**.

I claim:

1. A sterilizer for toilet spray attachment comprising:

a liquid reservoir filled with sterilizing agents or cleaning chemicals therein and having a top cover drilled with a venting hole thereon;

a delivery tube connected with said liquid reservoir and having a lower discharge port associated therewith;

a mixing portion inserted with a mixing mesh adapted for mixing the sterilizing agents or cleaning chemicals and water and perpendicularly connected with the lower portion of said delivery tube disposed within a toilet bowl under a toilet seat;

said mixing portion connected between a water conduit which is communicated with a warm water reservoir and controlled by a valve, and a spray nozzle adapted for spraying a user's anus or genitals, said warm water reservoir supplied with pressurized water as boosted by a boosting pump provided on an inlet pipe of a water source, said mixing portion positioned beyond the perpendicular connection of the lower portion of said delivery tube; and a sealer normally sealing the lower port of said delivery tube; the improvement which comprises:

said sealer generally formed as a spherical shape and resiliently held by a spring link which is secured toward said mixing portion to normally seal said lower port of said delivery tube and operatively opened by the downcoming pressurized water from said water source, whereby upon the opening of said valve of said water conduit, the pressurized water flowing downstream of said mixing portion will open said sealer to drain the sterilizing agents or cleaning chemicals from said liquid reservoir so that the water and the liquid will be thoroughly mixed in said mixing portion and finally sprayed through said spray nozzle for cleansing the user's anus or genitals.

2. A sterilizer for toilet spray attachment comprising:

a liquid reservoir filled with sterilizing agents or cleaning chemicals therein and having a top cover drilled with a venting hole thereon;

a delivery tube connected with said reservoir and having associated therewith a lower discharge port; and a mixing portion having a mesh adapted for mixing the sterilizing agents or cleaning chemicals and water therein and connected between a water conduit which is communicated with a water source and controlled by a valve, and a spray nozzle adapted for spraying a user's anus or genitals, the water source having the water pressurized by a boosting pump provided on an inlet pipe of the water source;

the improvement which comprises:

said mixing portion having a throat portion communicated with a tapered small hole which is formed on the lower discharge port of said delivery tube to normally hold the sterilizing agents or cleaning chemicals from said liquid reservoir in situ as the cohesive force of the liquid acting upon the tube wall especially at the tapered small hole without drainage loss, whereby upon the opening of said valve of said water conduit, the pressurized water will flow downwards to suck the sterilizing agents or cleaning chemicals in said liquid reservoir through said tapered small hole so that the water and the liquid will be thoroughly mixed in said mixing portion for spraying and cleaning purposes.

* * * * *